US008070279B2

(12) United States Patent
Miura

(10) Patent No.: US 8,070,279 B2
(45) Date of Patent: Dec. 6, 2011

(54) LIQUID EJECTION HEAD, LIQUID CARTRIDGE, AND IMAGE FORMING APPARATUS

(75) Inventor: Kunihiro Miura, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 942 days.

(21) Appl. No.: 12/072,735

(22) Filed: Feb. 28, 2008

(65) Prior Publication Data

US 2008/0303884 A1 Dec. 11, 2008

(30) Foreign Application Priority Data

Mar. 1, 2007 (JP) ..... 2007-050886

(51) Int. Cl.
*B41J 2/175* (2006.01)

(52) U.S. Cl. ..... 347/93; 347/84; 347/87

(58) Field of Classification Search ..... 347/68–72, 347/85–87, 93
See application file for complete search history.

(56) References Cited

U.S. PATENT DOCUMENTS

| | | | | |
|---|---|---|---|---|
| 5,087,930 | A * | 2/1992 | Roy et al. | 347/85 |
| 5,594,481 | A * | 1/1997 | Keefe et al. | 347/65 |
| 6,557,985 | B2 * | 5/2003 | Hosono et al. | 347/70 |
| 2003/0063171 | A1 * | 4/2003 | Otsuka et al. | 347/94 |
| 2004/0141857 | A1 * | 7/2004 | Takeuchi et al. | 417/322 |
| 2007/0246614 | A1 | 10/2007 | Allmann et al. | |

FOREIGN PATENT DOCUMENTS

| | | |
|---|---|---|
| JP | 2000-296613 | 10/2000 |
| JP | 2002-79684 | 3/2002 |
| JP | 2002-355962 | 12/2002 |
| JP | 3389732 | 1/2003 |
| JP | 2003-334413 | 11/2003 |
| JP | 2006-69106 | 3/2006 |
| JP | 3809787 | 6/2006 |
| JP | 2006-198945 | 8/2006 |

OTHER PUBLICATIONS

U.S. Appl. No. 11/786,725, filed Apr. 11, 2007.
Aug. 30, 2011 Japanese official action in connection with a counterpart Japanese patent application.

* cited by examiner

*Primary Examiner* — Ellen Kim
(74) *Attorney, Agent, or Firm* — Cooper & Dunham LLP

(57) ABSTRACT

A liquid ejection head including a plurality of nozzles, a plurality of pressurizing liquid chambers, a liquid supply portion, and a filter portion. The plurality of nozzles ejects liquid droplets. The plurality of pressurizing liquid chambers are in fluid communication respectively with the nozzles. The liquid supply portion includes a plurality of individual supply channels and a fluid-communicating portion. The plurality of individual supply channels are in fluid communication respectively with the pressurizing liquid chambers to supply a liquid to the pressurizing liquid chambers. The fluid-communicating portion keeps the plurality of individual supply channels in fluid communication with one another. The filter portion is positioned to face the individual supply channels of the liquid supply portion and filters the liquid supplied to the pressurizing liquid chambers.

18 Claims, 10 Drawing Sheets

LIQUID EJECTION HEAD, LIQUID CARTRIDGE, AND IMAGE FORMING APPARATUS

TECHNICAL FIELD

This disclosure relates to a liquid ejection head, a liquid cartridge using the same head, and an image forming apparatus using the same head or cartridge.

DESCRIPTION OF RELATED ART

An image forming apparatus used as a printer, facsimile machine, copier, plotter, or multi-functional device thereof may have a liquid ejection device including a liquid ejection head or recording head. Such an image forming apparatus ejects droplets of recording liquid from the liquid ejection head to form a desired image on a sheet.

The term "sheet" used herein refers to a medium, a recording medium, a recorded medium, a sheet material, a transfer material, a recording sheet, a paper sheet, or the like. The sheet may also be made of material such as paper, string, fiber, cloth, leather, metal, plastic, glass, timber, and ceramic. Further, the term "image formation" used herein refers to providing, recording, printing, or imaging an image, a letter, a figure, a pattern, or the like onto the sheet. Moreover, the term "liquid" used herein is not limited to recording liquid or ink, and may include anything ejected in the form of a fluid. Hereinafter, such liquid may be simply referred to as "ink". Furthermore, the term "liquid ejection device" refers to a device ejecting liquid from a liquid ejection head to form an image, a letter, a figure, a pattern, or the like.

There are known various types of liquid ejection heads which employ, as pressure generator (actuator) for generating pressure to pressurize ink or other liquid in each of individual flow channels (hereinafter referred to also as "pressurizing liquid chambers"), a piezoelectric actuator formed of a piezoelectric element, a thermal actuator formed of a heating resistance element, and an electrostatic actuator generating an electrostatic force.

In such an image forming apparatus, higher speed and higher image quality are demanded. To obtain higher image quality, various attempts have been made to reduce the size of a liquid droplet and to increase the density of nozzles. Also, to obtain higher speed, various attempts have been made to eject the liquid droplet at a higher driving frequency, and to employ a longer head that is represented by a line head having a larger number of nozzles per head.

Thus, in such an image forming apparatus of the liquid ejection type, a liquid ejection head is demanded to eject liquid droplets at higher speed and to have a larger number of nozzles with an increase of the head size. Further, a metal plate or a resin plate is selected so as to meet a demand for reducing the cost of a flow channel plate (flow channel member) having complicated shapes of liquid flow channels. In particular, because a silicon material has a high cost, a stainless material tends to be selected as a comparatively advantageous material. In the case using a stainless material, however, it is not preferable to form the flow channel member by a plurality of plates for the reason that the stainless material has a difficulty in bonding.

The liquid ejection head is constituted by nozzles and liquid chambers which are each formed in size of several tens microns. Therefore, an ejection failure may occur if foreign matters having entered the nozzles or the liquid chambers in the manufacturing process or foreign matters deposited in an ink supply system are caused to flow with liquid droplets and one or more nozzles are closed by clogging of the foreign matters. Such a situation increases the incidence of a failure of the liquid droplet ejection through the nozzles and greatly affects the yield of heads manufactured.

Hence, certain conventional liquid ejection heads employ a filter to remove foreign matters so that the foreign matters may not flow into the nozzles. For example, one conventional liquid ejection head has a flow channel plate made of silicon in which a liquid supply section in fluid communication with a pressurizing fluid chamber and a filter structure are both provided.

In one conventional liquid ejection head, a flow channel plate is formed by a plurality of plates and a filter is disposed between the liquid supply side and a pressurizing liquid chamber, enhancing a bubble purging property in a filter section.

In one conventional liquid ejection head, a filter chamber is disposed midway a supply flow channel from the ink supply side to a pressurizing liquid chamber to divide the supply flow channel so as to enhance a bubble purging property.

In one conventional liquid ejection head, ink is supplied to a pressurizing chamber through a filter section formed of the same member as that forming a vibrating plate.

As described above, when a filter for removing foreign matters is disposed in a liquid flow channel extending from a liquid cartridge, which contains a liquid supplied to a liquid ejection head, to a nozzle of the liquid ejection head, as the filter is disposed at a more upstream position in the liquid flow channel, the foreign matters may not be removed in a larger area, resulting in more difficulties in reliably removing the foreign matters. By contrast, as the filter is disposed at a position nearer to the nozzle, the foreign matters entering the nozzle may be removed with higher efficiency.

In the latter case, when individual liquid flow channels are formed independently of one another, a filter area provided for 1 bit (one liquid flow channel) may be so small. Consequently, for example, adherence of bubbles or relatively small foreign matters to the filter may prevent a sufficient amount of the liquid from being supplied, which may adversely affect an ejection characteristic of the liquid droplets.

Further, conventional liquid ejection heads as described above may have a disadvantage in cost reduction that a larger number of parts are needed because an expensive silicon material is used for a flow channel plate, a flow channel plate is formed by a plurality of plates, or a filter section is constituted as a filter unit structure using a separate filter unit.

Therefore, there is a need for a liquid ejection head capable of effectively removing foreign matters without causing insufficient liquid supply, a liquid cartridge having the same head, and an image forming apparatus using the same head or the same cartridge.

BRIEF SUMMARY

In an aspect of this disclosure, there is provided a liquid ejection head capable of effectively removing foreign matters without causing insufficient liquid supply, a liquid cartridge having the same head, and an image forming apparatus using the same head or the same cartridge.

In another aspect, a liquid ejection head includes a plurality of nozzles, a plurality of pressurizing liquid chambers, a liquid supply portion, and a filter portion. The plurality of nozzles ejects liquid droplets. The plurality of pressurizing liquid chambers are in fluid communication respectively with the nozzles. The liquid supply portion includes a plurality of individual supply channels and a fluid-communicating portion. The plurality of individual supply channels are in fluid communication respectively with the pressurizing liquid chambers to supply a liquid to the pressurizing liquid chambers. The fluid-communicating portion keeps the plurality of individual supply channels in fluid communication with one another. The filter portion is positioned to face the individual supply channels of the liquid supply portion and filters the liquid supplied to the pressurizing liquid chambers.

BRIEF DESCRIPTION OF THE DRAWINGS

A more complete appreciation of the aforementioned and other features, aspects and advantages will be better understood by reference to the following detailed description when considered in connection with the accompanying drawings, wherein.

Figure 1:
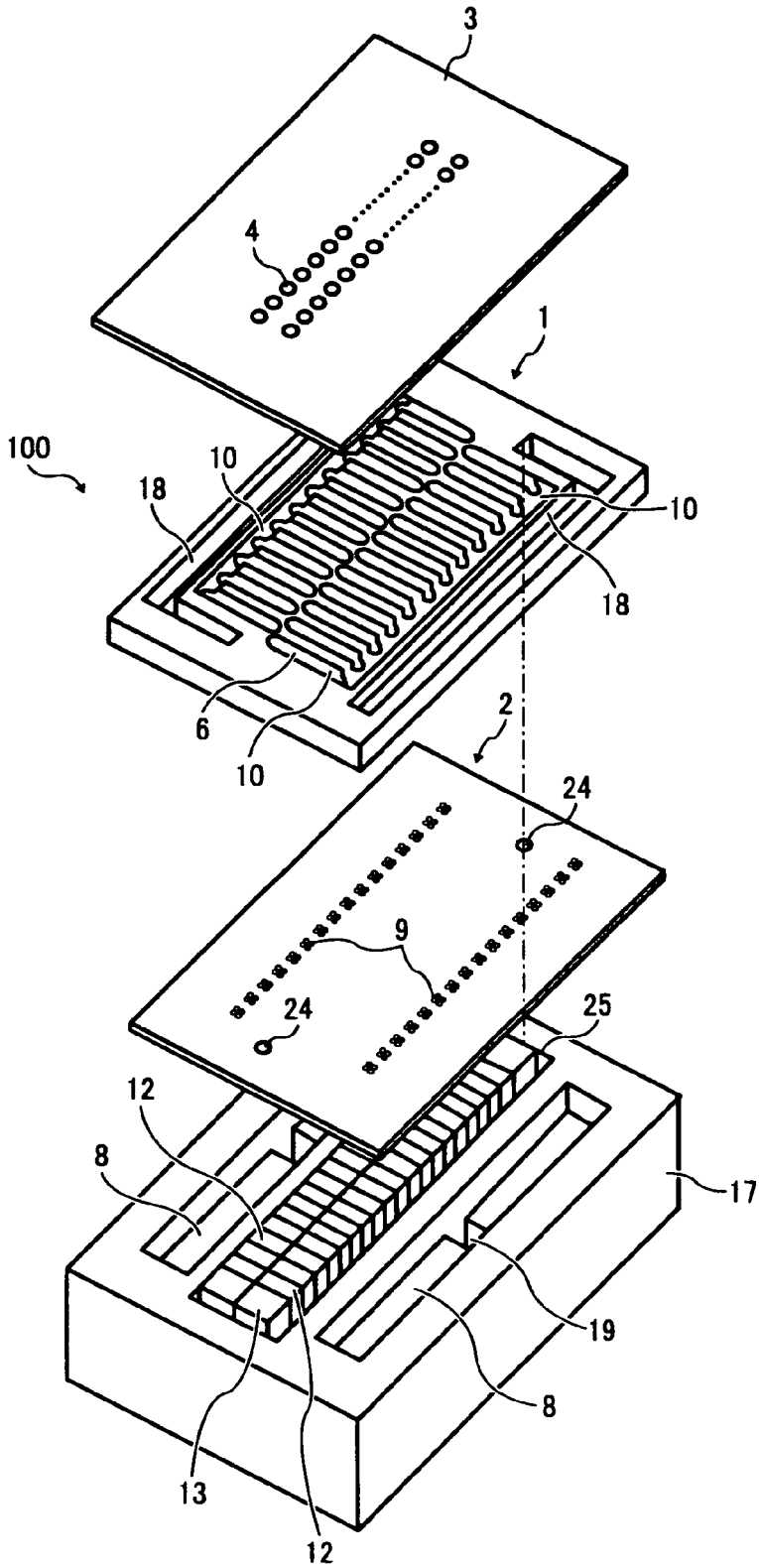
FIG. 1 is an exploded perspective explanatory view illustrating a liquid ejection head according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results. For the sake of simplicity, the same reference numerals are used in the drawings and the descriptions for the same materials and constituent parts having the same functions, and redundant descriptions thereof are omitted.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions, and redundant descriptions thereof are omitted.

First, a liquid ejection head according to an exemplary embodiment of the present invention is described with reference to FIGS. 1 to 3.

Figure 2:
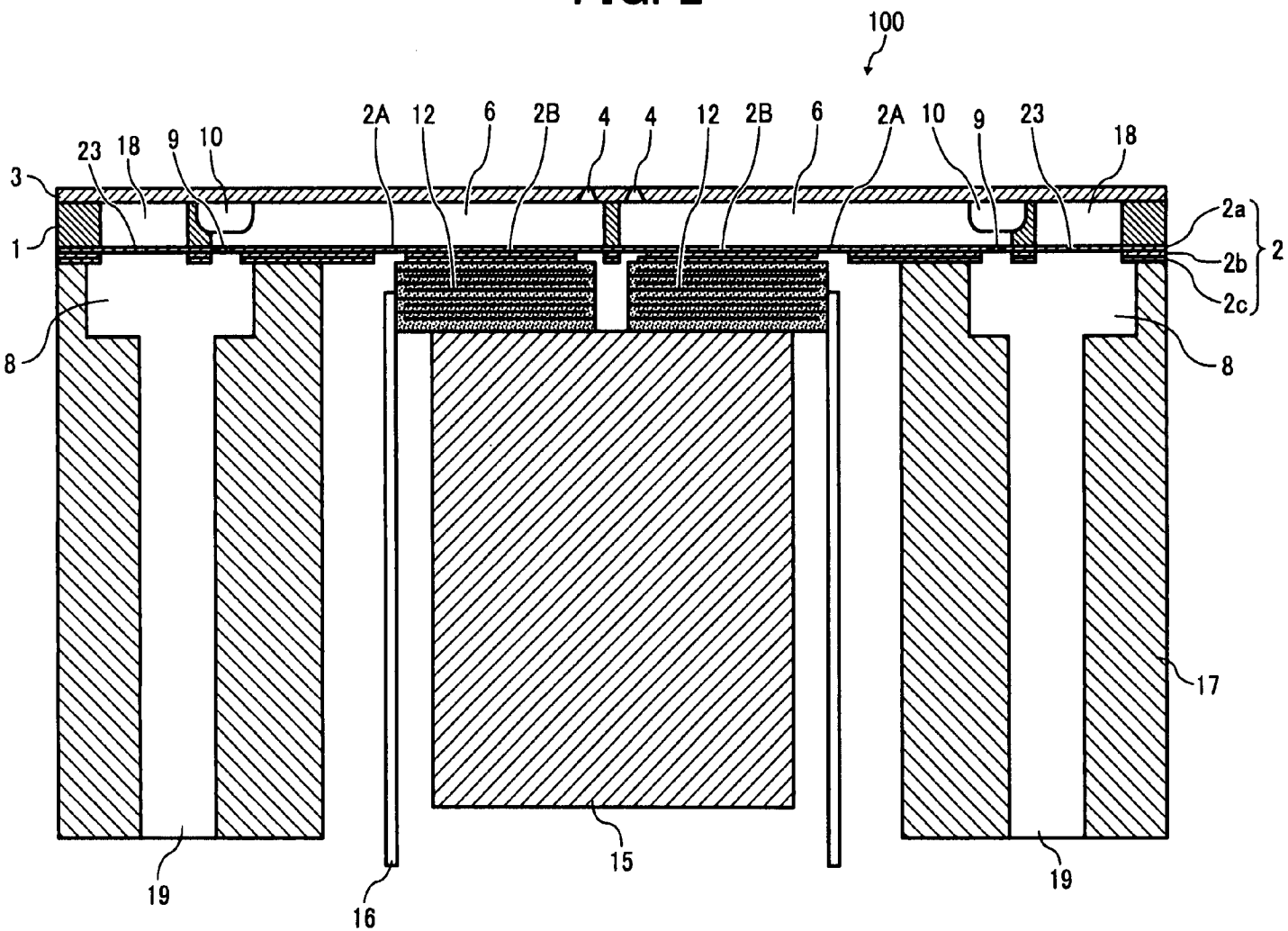
FIG. 2 is a sectional explanatory view of the liquid ejection head, taken along a longitudinal direction of a liquid chamber therein.
Figure 3:
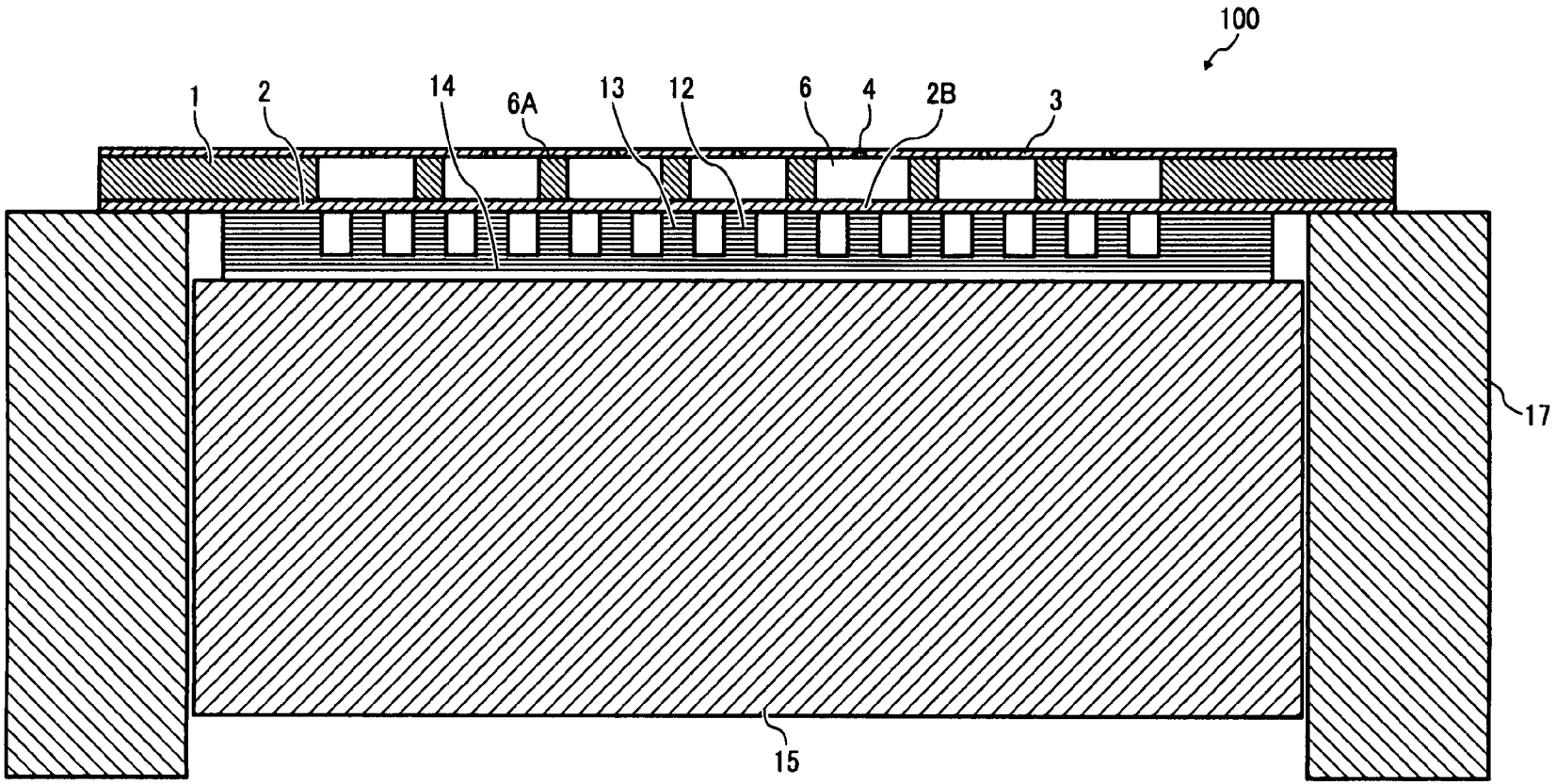
FIG. 3 is a sectional explanatory view of the liquid ejection head, taken along a transverse direction of the liquid chamber.

FIG. 1 is an exploded perspective explanatory view of the liquid ejection head, FIG. 2 is a sectional explanatory view of the liquid ejection head taken along a longitudinal direction of a liquid chamber (i.e., a direction perpendicular to the direction in which nozzles are arrayed) therein, and FIG. 3 is a sectional explanatory view of the liquid ejection head of FIG. 1 taken along the transverse direction of the liquid chamber (i.e., the direction in which the nozzles are arrayed) therein.

In FIG. 1, a liquid ejection head 100 includes a flow channel plate (also called a flow channel member or a liquid chamber substrate) 1, a vibrating plate 2 joined to a lower surface of the flow channel plate 1 and serving as a vibrating plate member, and a nozzle plate 3 joined to an upper surface of the flow channel plate 1. Those three plates cooperatively form pressurizing liquid chambers (also called pressure chambers, pressurizing chambers, flow channels, etc.) 6 serving as individual flow channels which are in fluid communication with nozzles 4 for ejecting liquid droplets, liquid supply portions 10 for supplying the liquid, e.g., ink, to the pressurizing liquid chambers 6, and damper chambers 18.

The flow channel plate 1 is made of a SUS substrate in which openings, etc., are formed to define the pressurizing liquid chambers 6, the liquid supply portions 10, and the damper chambers 18, etc., by etching using an acidic etchant or mechanical machining such as stamping or punching.

As shown in FIG. 2, the vibrating plate 2 is formed of a nickel plate with a three-layer structure having a first layer film 2*a*, a second layer film 2*b*, and a third layer film 2*c* which are formed in the order named from the side close to the pressurizing liquid chambers 6. The vibrating plate 2 is fabricated, for example, by electroforming. The first layer film 2*a* of the vibrating plate 2 has a film thickness of about 1 to 5 mm, the second layer film 2*b* has a film thickness of about 10 to 20 mm, and the third layer film 2*c* has a film thickness of about 10 to 20 mm. Thus, the vibrating plate 2 is formed in a thickness of 20 to 45 mm.

The nozzle plate 3 has a large number of nozzles 4 formed in a corresponding relation to the pressurizing liquid chambers 6 and is bonded to the flow channel plate 1 by an adhesive. The nozzle plate 3 can be made of metal such as stainless steel or nickel, resin such as a polyimide resin film, silicon, or a combination thereof. Each of the nozzles 4 has an interior shape that is horn-like (substantially circular columnar or substantially conical). A hole defining the nozzle 4 has a diameter of about 20 to 35 mm on the exit side of the ink droplet. In addition, the nozzles in each row are arrayed at a pitch of 150 dpi.

A nozzle surface (surface on the side where the liquid droplets are ejected, i.e., an ejection surface) of the nozzle plate 3 has a water-repellent layer (not shown) which is formed by water-repellent surface treatment. The water-repellent layer can be provided by forming a water-repellent film, which is selected depending on physical properties of the recording liquid, by any of eutectoid plating of PTFE-Ni, electrode position coating of a fluorine contained resin, evaporation coating of an evaporable fluorine contained resin, e.g., pitch fluoride, and a process of applying a solution of a silicon-based resin or a fluorine-based resin and baking the applied resin. The presence of the water-repellent layer is effective in stabilizing the droplet shape and the flying characteristic of the recording liquid and in obtaining high image quality.

Further, as shown in FIGS. 2 and 3, the vibrating plate 2 includes diaphragm portions (vibrating plate regions) 2A which are formed by the first layer film 2*a* corresponding to the pressurizing liquid chambers 6 in a one-to-one relation, and projections 2B which have a two-layer structure made up of the second layer film 2*b* and the third layer film 2*c* and which are formed in central areas of the diaphragm portions 2A. Piezoelectric elements 12 constituting pressure generator, serving as actuators, are joined respectively to the projections 2B. Further, posts 13 are jointed to three-layer structure portions, including the projections 2B, of the vibrating plate 2 corresponding to partitions 6A between the pressurizing liquid chambers 6 adjacent to each other.

The piezoelectric elements 12 and the posts 13 are fabricated by forming slits in a laminated piezoelectric-element member 14 by half-cut dicing such that the laminated piezoelectric-element member 14 is partially divided into the form of comb teeth. In other words, the posts 13 are also formed by piezoelectric elements, but these piezoelectric elements serve merely as posts because no driving voltage is applied to them. The laminated piezoelectric-element member 14 is joined to a base member 15.

The piezoelectric elements 12 (laminated piezoelectric-element member 14) are formed, for example, by alternately laminating a piezoelectric layer made of lead zirconate titanate (PZT) and having a thickness of 10 to 50 mm/layer, and an internal electrode layer made of silver palladium (AgPd) and having a thickness of several mm/layer. The internal electrodes are alternately electrically connected to individual electrodes and a common electrode, which serve as end-face electrodes (external electrodes) located at respective end faces of the internal electrodes. A driving signal is supplied to those electrodes via FPC (flexible printed circuit) cables 16.

The piezoelectric direction of the piezoelectric elements 12 can be set such that the recording liquid in the pressurizing liquid chamber 6 is pressurized by employing displacements in the d33 direction, or that the recording liquid in the pressurizing liquid chamber 6 is pressurized by employing displacements in the d31 direction. In the embodiment, the piezoelectric direction is set by employing the displacements in the d33 direction.

The base member 15 is preferably made of a metallic material. By using metal as the material of the base member 15, heat accumulation due to self-heating of the piezoelectric elements 12 can be avoided. The piezoelectric elements 12 and the base member 15 are bonded to each other by an adhesive. When the number of channels is increased, temperature rises up to near 100° C. by the self-heating of the piezoelectric elements 12 and the strength of the bonding remarkably deteriorates. Further, the temperature within the head is raised by the self-heating of the piezoelectric elements 12, and the ink temperature is also raised correspondingly. With a rise of the ink temperature, however, the ink viscosity is lowered and the ejection characteristic is greatly affected. Thus, by using the base member 15 made of a metallic material for the purpose of avoiding the heat accumulation due to the self-heating of the piezoelectric elements 12, it is possible to prevent not only a reduction of the strength of the bonding between the piezoelectric elements 12 and the base member 15, but also deterioration of the ejection characteristic caused by lowering of the viscosity of the recording liquid.

Further, a frame member 17 made of an epoxy-based resin or polyphenylene sulfide and formed by injection molding, for example, is bonded to a peripheral portion of the vibrating plate 2 by an adhesive.

The frame member 17 has common liquid chambers 8 formed therein for supplying the recording liquid to the pressurizing liquid chambers 6. The recording liquid is supplied from the common liquid chambers 8 to the pressurizing liquid chambers 6 through filter portions 9 formed in the vibrating plate 2 and through the liquid supply portions 10 formed in the flow channel plate 1. The frame member 17 also has recording liquid supply ports 19 for supplying the recording liquid to the common liquid chambers 8 from the exterior. As shown in FIG. 1, the common liquid chambers 8 are each formed in a rectangular shape when viewed in a plan, which is elongate in the direction in which the pressurizing liquid chambers 6 are arrayed side by side, i.e., the direction in which the nozzles are arrayed (hereinafter referred to as the "longitudinal direction of the common liquid chamber").

A damper portion 23 defining part of wall surfaces of the common liquid chamber 8 is formed by the first layer film 2*c* of the vibrating plate 2, which forms a wall surface of the pressurizing liquid chamber 6. A damper chamber 18 serves as a space open to the atmosphere through an atmosphere fluid-communication port 24 which is formed in the vibrating plate 2 as a fluid-communication passage held in fluid communication with the exterior or atmosphere. The atmosphere fluid-communication port 24 is formed at a position where it is opened to a space 25 that is left as a gap when the frame member 17 and the piezoelectric elements 12 are assembled together.

In the liquid ejection head 100 thus constructed, for example, when a voltage applied to the piezoelectric element 12 is reduced from a reference potential, the piezoelectric element 12 is contracted and the diaphragm portion 2A of the vibrating plate 2 is moved downward. Correspondingly, the volume of the pressurizing liquid chamber 6 is expanded, thus causing the ink to enter the pressurizing liquid chamber 6. Thereafter, when the voltage applied to the piezoelectric element 12 is increased to extend the piezoelectric element 12 in the layer-laminating direction, the diaphragm portion 2A of the vibrating plate 2 is deformed in the direction toward the nozzle 4 and the volume (or cubic volume) of the pressurizing liquid chamber 6 is contracted. As a result, the recording liquid in the pressurizing liquid chamber 6 is pressurized and droplets of the recording liquid are ejected from the nozzle 4.

When the voltage applied to the piezoelectric element 12 is returned to the reference potential, the vibrating plate 2 restores to its initial position, whereupon the pressurizing liquid chamber 6 is expanded to generate a negative pressure. At that time, therefore, the recording liquid is filled into the pressurizing liquid chamber 6 from the common liquid chamber 8. After vibrations of a meniscus surface in the nozzle 4 are attenuated and stabilized, the operation for ejecting the liquid droplets in a next cycle is started.

A head driving method is not limited to the above-described example (called "pull-push driving"), and another method called "pull driving" or "push driving" can also be performed depending on how a driving waveform is to be applied.

Figure 4:
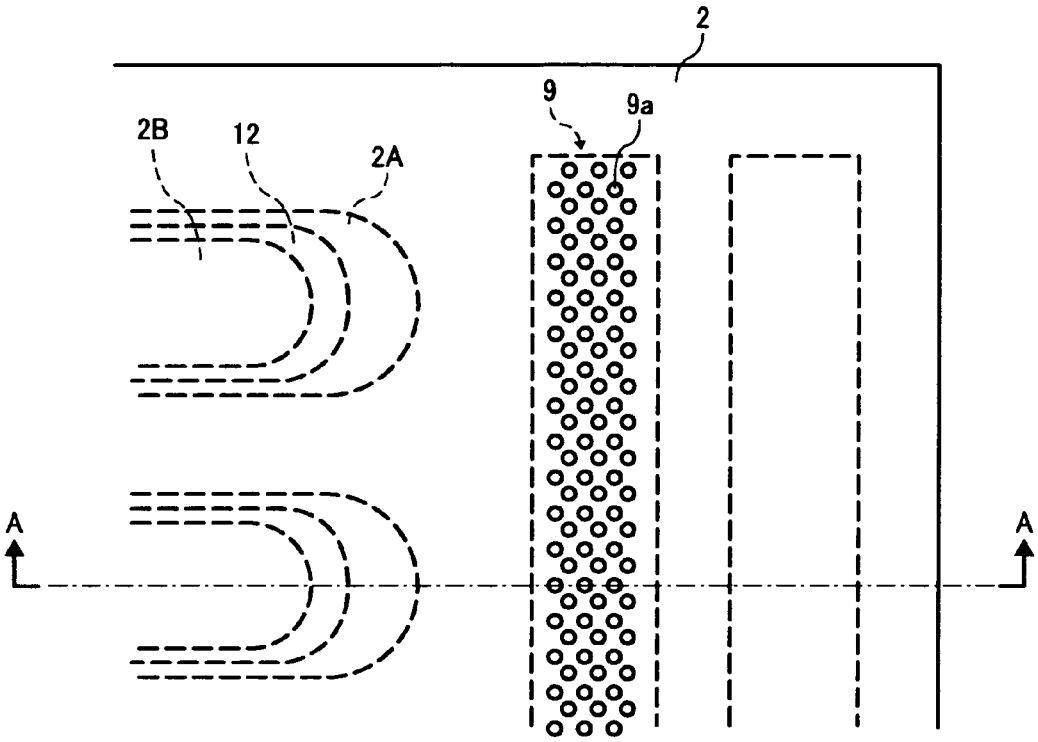
FIG. 4 is a partial plan explanatory view of a vibrating plate in the liquid ejection head.
Figure 5:
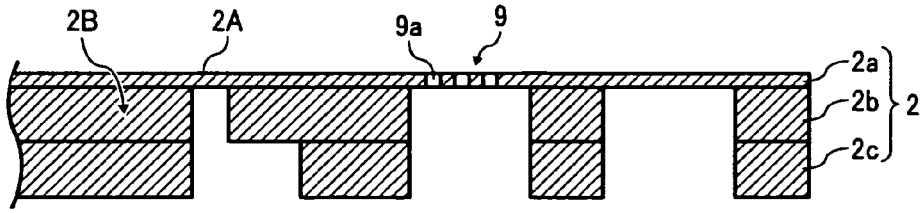
FIG. 5 is a sectional explanatory view taken along a line A-A in FIG. 4.
Figure 6:
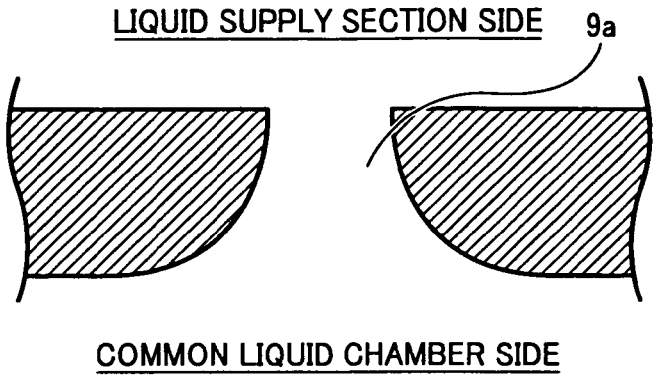
FIG. 6 is a partial sectional explanatory view for explaining the sectional shape of a fluid-communication hole formed in a filter portion in the liquid ejection head.

Next, details of the filter portions 9 of the vibrating plate 2 in the liquid ejection head 100 are described with reference to FIGS. 4 to 6. FIG. 4 is a partial plan explanatory view of the vibrating plate, FIG. 5 is a sectional explanatory view taken along a line A-A in FIG. 4, and FIG. 6 is an enlarged sectional explanatory view for explaining the sectional shape of a fluid-communication hole constituting the filter portion.

A plurality of fluid-communication holes 9*a* constituting the filter portion 9 are formed in the first layer film 2*a* of the vibrating plate 2 so as to define the filter portion 9 extending in the direction in which the pressurizing liquid chambers 6 are arrayed side by side. The thickness of the first layer film 2*a* is preferably about 3 mm. As shown in FIG. 6, each of the fluid-communication holes 9*a* constituting the filter portion 9 has an interior shape that is horn-like (orifice-like, substantially circular columnar, or substantially conical). The diameter of the fluid-communication hole 9*a* is set comparable to or smaller than that of the nozzle 4 on the side facing the flow channel plate 1.

By forming the fluid-communication hole 9*a* in an orifice-like shape in the filter portion 9, flow resistance of the liquid can be further reduced and the liquid can be stably supplied to the pressurizing liquid chamber 6. The plan shape of the fluid-communication hole 9*a* is not limited to a circular shape. In view of the fact that an opening rate of the fluid-communication holes 9*a* per unit area is a factor greatly affecting the flow resistance of the liquid, the fluid-communication holes 9*a* can also be formed in a polygonal shape such that the holes are arrayed with higher efficiency or density.

Figure 7:
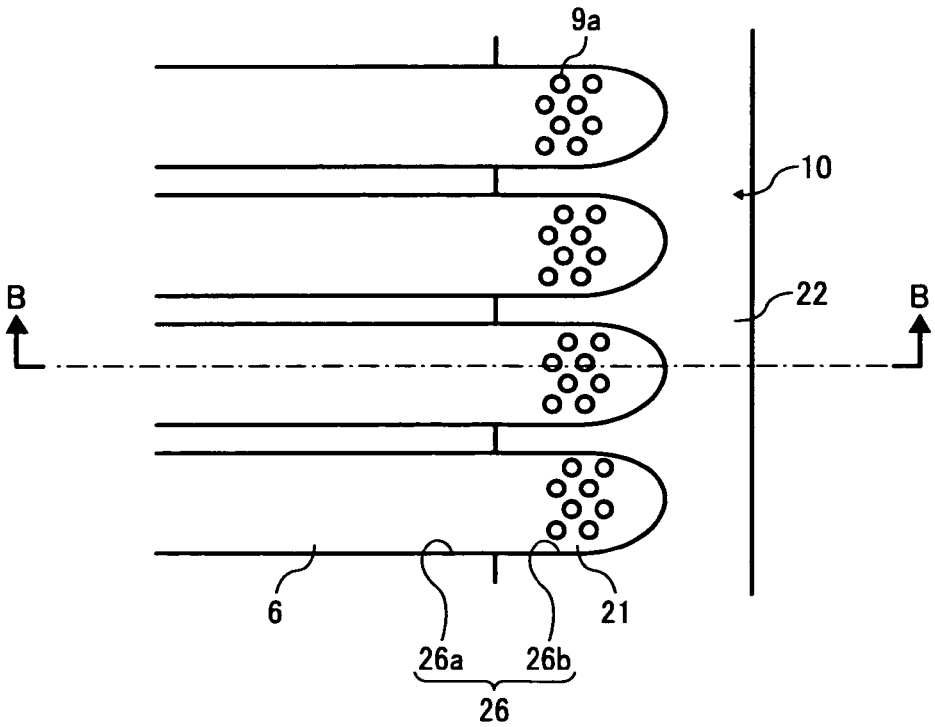
FIG. 7 is a partial plan explanatory view of a flow channel member and the vibrating plate in the liquid ejection head.
Figure 8:
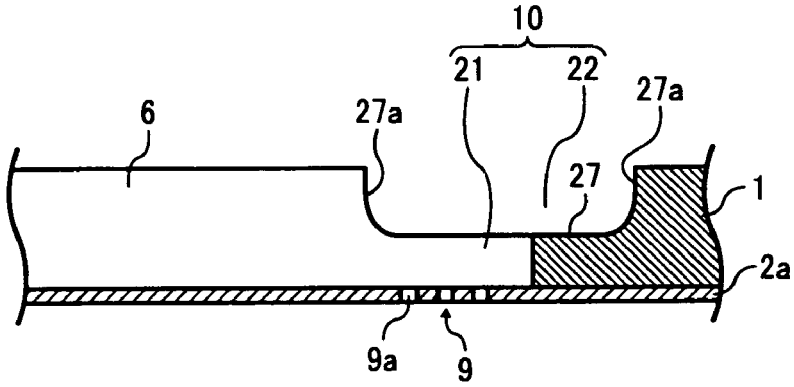
FIG. 8 is a sectional explanatory view taken along a line B-B in FIG. 7.
Figure 9:
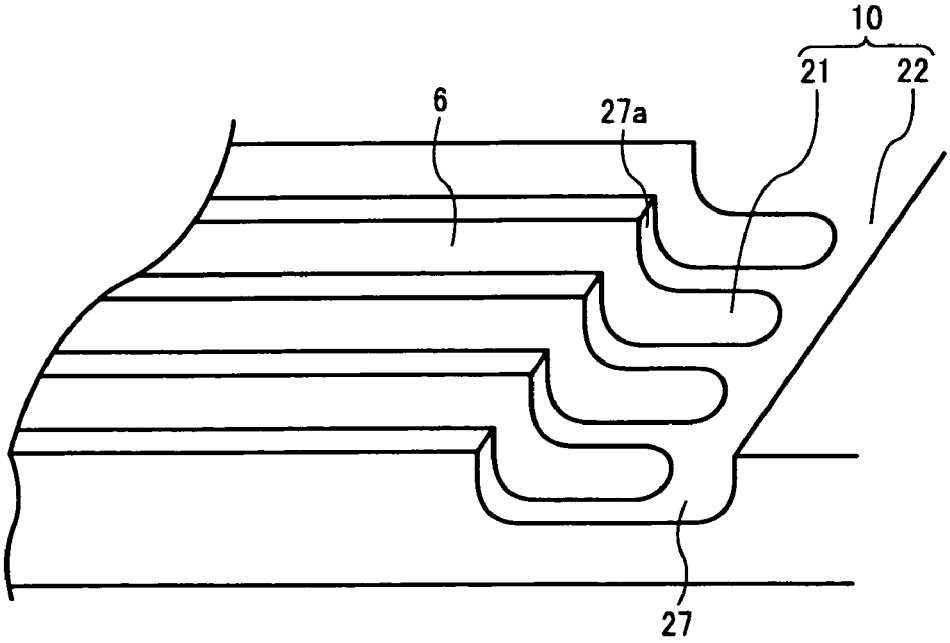
FIG. 9 is a partial perspective explanatory view of the flow channel member shown in FIG. 7.

Next, details of the liquid supply portion 10 of the flow channel plate 1 in the liquid ejection head 100 are described with reference to FIGS. 7 to 9. FIG. 7 is a partial plan explanatory view of the flow channel member, FIG. 8 is a sectional explanatory view taken along a line B-B in FIG. 7, and FIG. 9 is a partial perspective explanatory view of the flow channel member shown in FIG. 7.

The liquid supply portion 10 formed in the flow channel plate 1 is constituted by parts of the pressurizing liquid chambers 6, individual supply channels 21 in fluid communication respectively with the pressurizing liquid chambers 6 and supplying the liquid to the pressurizing liquid chambers 6, a fluid-communication portion 22 for keeping the plurality of individual supply channels in fluid communication with one another. Stated another way, the flow channel plate 1 is formed with a plurality of through grooves 26 which penetrate through the flow channel plate 1 in the direction of thickness thereof and which integrally form portions 26*a* serving as the pressurizing liquid chambers 6 and portions 26*b* serving as the individual supply channels 21, and with a recess 27 which is extended in the direction of side-by-side array of the pressurizing liquid chambers 6 and which keeps the portions 26*b*, serving as the individual supply channels 21, of the plurality of through grooves 26 in fluid communication with one another. The portions 26*b*, serving as the individual supply channels 21, of the through grooves 26 are formed to be open toward the filter portion 9 such that the individual supply channels 21 in the liquid supply portion 10 are positioned to face the filter portion 9. Also, the portions 26*b* are formed to be open for continuation to the bottom of the recess 27 such that the individual supply channels 21 are kept in fluid communicated with one another through the fluid-communicating portion 22. By employing the through grooves to form the pressurizing liquid chambers 6, etc., a sufficient volume of each liquid chamber can be ensured and a thin plate material can be used as the flow channel plate 1, thus resulting in higher machining accuracy.

Further, by forming the individual supply channels 21 in fluid communication with the pressurizing liquid chambers 6 so as to face the filter portion 9 and by providing the fluid-communicating portion 22 which keeps the individual supply channels 21 in fluid communication with one another, foreign matters can be removed by the filter portion 9 at a position located near the nozzles 4. If portions of the through grooves 26, which are positioned downstream of the filter portion 9 in the direction of flow of the liquid, are constituted by only the individual supply channels 21 independent of one another, there may occur a risk that even bulbs or relatively small foreign matters clog part of the filter portion 9 and the liquid cannot be sufficiently supplied to some of the pressurizing liquid chambers 6. By contrast, in the embodiment, since the fluid-communicating portion 22 is provided to keep plural ones (all in the embodiment) of the individual supply channels 21 in fluid communication with one another, the liquid can be sufficiently supplied to the pressurizing liquid chambers 6. As a result, stable droplet ejection is ensured. Further, since the flow channel plate 1 is formed of a single plate in which the fluid-communicating portion 22 is formed to keep the individual supply channels 21 in fluid communication with one another, clogging of a particular bit (nozzle) by a foreign matter can be prevented while the rigidity of the filter portion 9 can be maintained.

Figure 10:
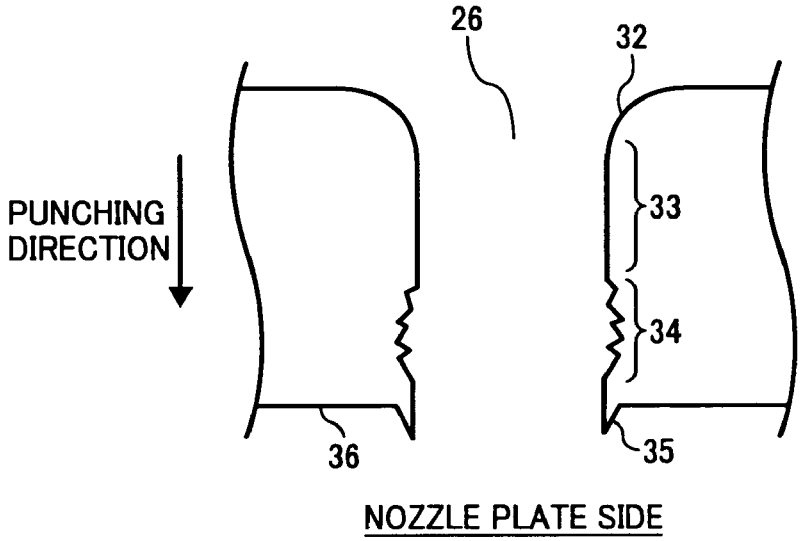
FIG. 10 is a partial enlarged explanatory view of a through-groove portion of the flow channel member in the liquid ejection head.
Figure 11:
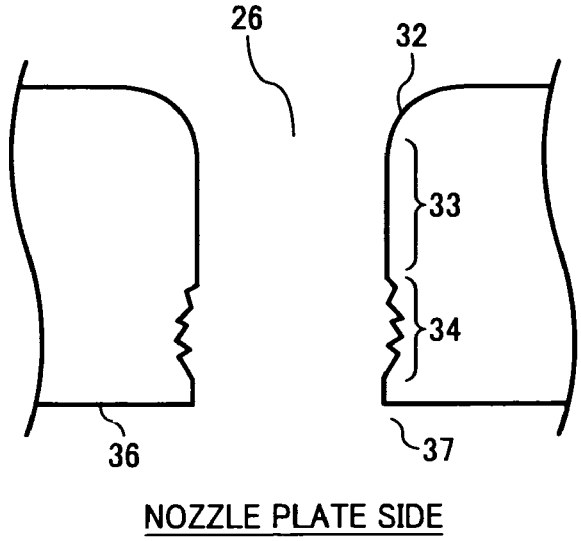
FIG. 11 is a partial enlarged explanatory view for explaining another shape of the through-groove portion of the flow channel member in the liquid ejection head.

The through grooves 26 of the flow channel plate 1 are formed by press working. FIG. 10 is a sectional explanatory view of the through groove 26 in the direction in which the liquid chambers are arrayed side by side. FIG. 10 indicates a state that stamping or punching with a press is completed. The stamping which occurs after a process of shearing is completed with a phenomenon that the flow channel plate 1 is ruptured at its rear side 36. With a press working process including transition from the shearing to the rupture, as shown in FIG. 10, edges 32 of the pressurizing liquid chamber, i.e., of the through groove on the side where the flow channel plate 1 is jointed to the vibrating plate 2 are deformed into rounded shapes because the flow channel plate 1 is stamped from that side to penetrate it. At the completion of the press working, a sidewall of the pressurizing liquid chamber 6, i.e., of the through groove 26 is in a state having a shorn portion 33, a ruptured portion 34, and a burr portion 35 which is generated in a final stage of the stamping in which the flow channel plate is penetrated thoroughly. If the generated burr portion 35 causes a problem in a step of joining the flow channel plate and the nozzle plate to each other, the burr portion 35 is preferably removed to become a flat portion 37 by mechanical machining, as shown in FIG. 11. If no problem arises depending on the joining method, the mechanical machining to remove the burr portion 35 is not required.

Thus, since the edges of the pressurizing liquid chamber, i.e., of the through groove, have the rounded shapes in one surface of the flow channel plate 1 on the side opposite to the other surface thereof at which the flow channel plate 1 is jointed to the nozzle plate 3, an excessive adhesive applied to the flow channel plate for bonding it to another member can be absorbed at the rounded edges and a stable ejection characteristic can be obtained.

Further, the recess 27 is formed in the fluid-communicating portion 22 by wet etching. Peripheral surfaces 27*a* of the recess 27 around the bottom thereof are each formed in a curved shape. Accordingly, flow resistance of the liquid is reduced when the liquid is supplied to the pressurizing liquid chambers 6, whereby stable supply of the liquid can be realized.

Figure 12:
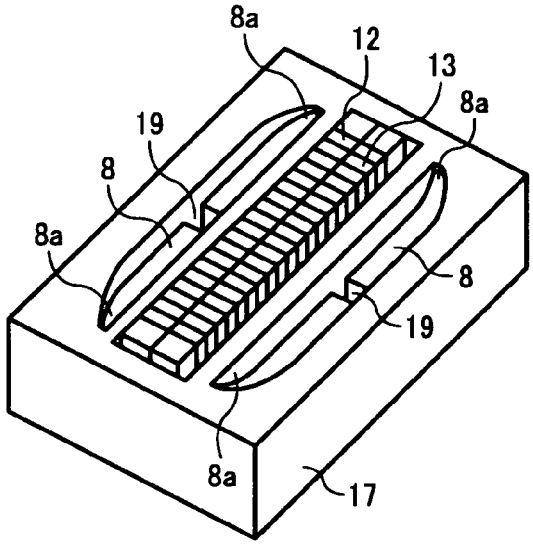
FIG. 12 is a perspective explanatory view showing another example of the shape of a common liquid chamber.

Next, another example of the structure of the common liquid chamber 8 is described with reference to FIG. 12. FIG. 12 is a perspective explanatory view of the frame member.

In FIG. 12, the common liquid chamber 8 is shaped so as to have a narrower width and a shallower depth at its opposite end portion 8*a* and 8*a* in the longitudinal direction. The common liquid chamber 8 having such a shape is advantageous in increasing flow efficiency of the recording liquid and purging efficiency of bubbles.

In the above-described embodiment has been described above, the filter portion is formed in the vibrating plate, although a filter member may be separately provided from the vibrating plate. Further, the above-described embodiment employs the piezoelectric elements as the actuators or driving elements for ejecting the liquid droplets. It should be noted that exemplary embodiments of the present invention are not limited to such piezoelectric heads and may be thermal heads or electrostatic heads.

Figure 13:
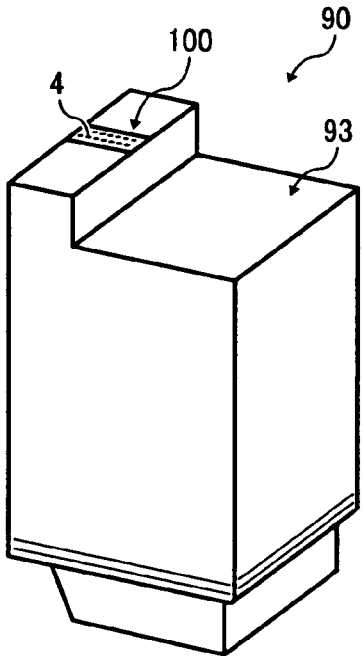
FIG. 13 is a perspective explanatory view of a liquid cartridge according to the present invention.

Next, a liquid cartridge according to an exemplary embodiment of the present invention is described with reference to FIG. 13. FIG. 13 is a perspective explanatory view illustrating one example of the liquid cartridge.

A liquid cartridge 90 includes, in an integral structure, a liquid ejection head 100 according to an exemplary embodiment of the present invention, which has nozzles 4, and a liquid container or tank 93 for supplying a liquid, e.g., a recording liquid, to the liquid ejection head 100.

Thus, the liquid cartridge integrally equipped with the liquid ejection head capable of stably ejecting ink droplets can be obtained.

Figure 14:
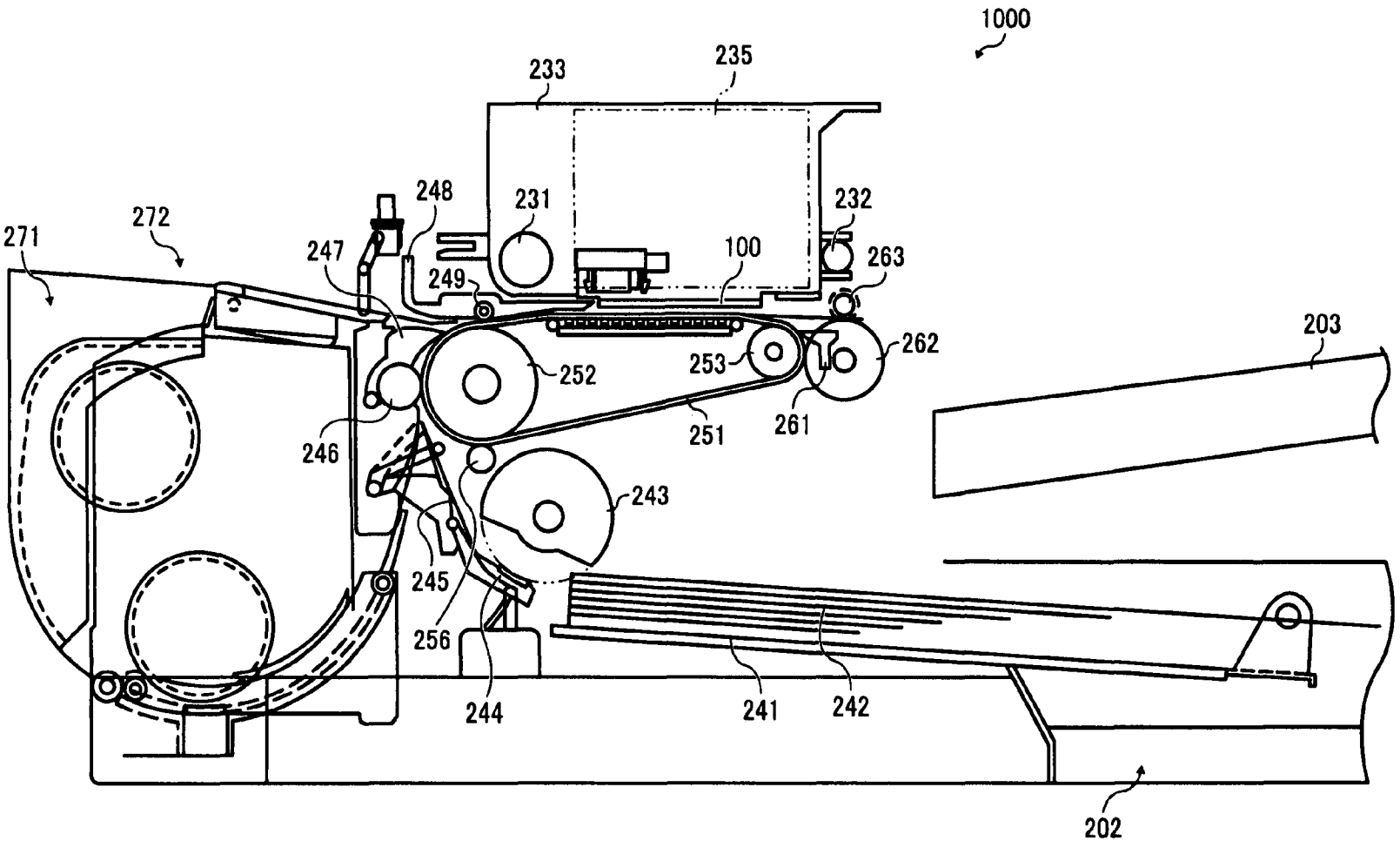
FIG. 14 is a schematic view showing the construction of one example of an image forming apparatus including a liquid ejection head according to an exemplary embodiment.

Next, an image forming apparatus according to an exemplary embodiment of the present invention, which includes a liquid ejection head according to an exemplary embodiment of the present invention, is described with reference to FIGS. 14 and 15. FIG. 14 is a schematic view for explaining the overall construction of a mechanism of the image forming apparatus, and FIG. 15 is a partial plan explanatory view of the mechanism of the image forming apparatus.

Figure 15:
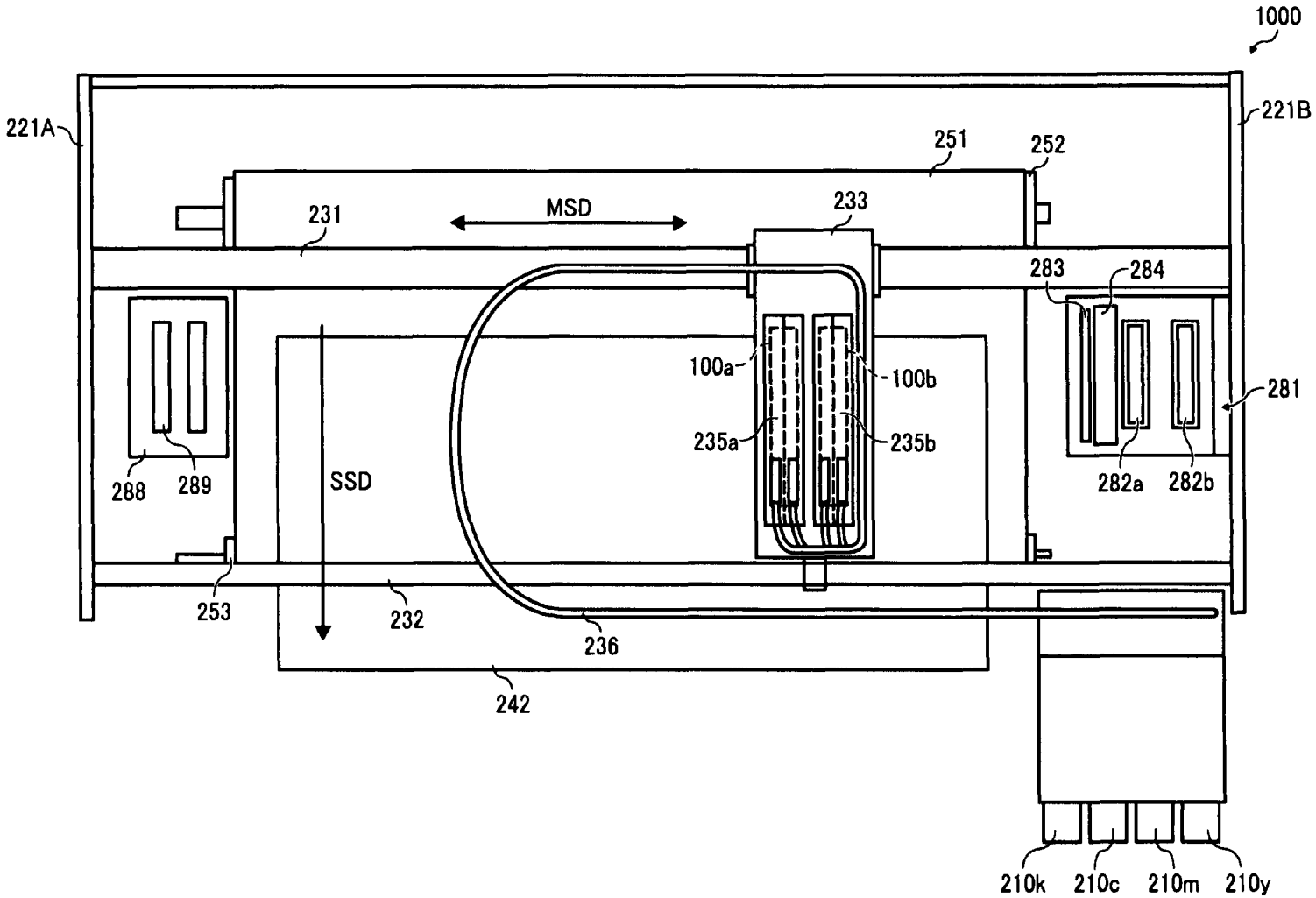
FIG. 15 is a partial plan explanatory view of the image forming apparatus of FIG. 14.

In FIGS. 14 and 15, an image forming apparatus 1000 is illustrated as a serial image forming apparatus. A main guide rod 231 and a sub-guide rod 232, each serving as a guide member, are horizontally supported by left and right side plates 221A, 221B, and a carriage 233 is supported by the guide rods 231 and 232 to be able to slide in main scan directions MSD indicated by a double arrow in FIG. 15. The carriage 233 is driven by a main scan motor (not shown) through a timing belt to move in the main scan directions MSD.

The carriage 233 includes liquid ejection heads 100*a* and 100*b* (also called "liquid ejection heads 234" when the individual liquid ejection heads are not required to be discriminated) according to an exemplary embodiment of the present invention. The liquid ejection heads 100*a* and 100*b* eject ink droplets in colors of yellow "Y", cyan "C", magenta "M" and black "K". The liquid ejection heads 234 are mounted to the carriage 233 such that nozzle rows each including a plurality of nozzles are arranged to extend in the sub-scan direction perpendicular to the main scan direction and the ink droplets are ejected downward.

Each of the liquid ejection heads 234 has two nozzle rows. One nozzle row of the recording head 234*a* ejects the ink droplets of black "K" and the other nozzle row thereof ejects the ink droplets of cyan "C". One nozzle row of the recording head 234*b* ejects the ink droplets of magenta "M" and the other nozzle row thereof ejects the ink droplets of yellow "Y".

Further, the carriage 233 mounts thereon liquid containers 93*a* and 93*b* (also called "liquid containers 93" when the individual liquid containers are not required to be discriminated), which supply the inks of respective colors corresponding to the nozzle rows in the liquid ejection heads 234. The inks of respective colors are replenished to the liquid containers 93 from ink cartridges 210, which contain the inks of respective colors, through supply tubes 36 provided for the inks of respective colors.

On the other hand, a paper feed section for feeding sheets 242 of paper stacked on a sheet stacking portion or pressure plate 241 of a paper feed tray 202 includes a semicircular roller or paper feed roller 243 and a separation pad 244 which is disposed to face the paper feed roller 243 and is made of a material having a large friction coefficient. The paper feed roller 243 and the separation pad 244 cooperatively separate and feed the sheets 242 one by one from the sheet stacking portion 241. The separation pad 244 is biased toward the paper feed roller 243.

In order to introduce the sheet 242 fed from the paper feed section toward the side under the liquid ejection heads 234, the image forming apparatus 1000 further includes a guide member 245 for guiding the sheet 242, a counter roller 246, a conveying guide member 247, and a retaining member 248 provided with a leading-end pressing roller 249. In addition, a conveying belt 251 serving as a conveying member is disposed to convey the fed sheet 242 in an opposed relation to the liquid ejection heads 234 while electrostatically attracting the sheet 242.

The conveying belt 251 is an endless belt which is stretched between a conveying roller 252 and a tension roller 253 and which is circulatively moved in a belt conveying direction, i.e., a sub-scan direction SSD indicated by an arrow in FIG. 15. A charging roller 256 is further disposed as a charger for charging the surface of the conveying belt 251. The charging roller 256 is arranged such that it contacts a surface layer of the conveying belt 251 and is rotated with the circulative movement of the conveying belt 251 in a following relation. The conveying belt 251 is circulatively moved in the sub-scan direction SSD with the conveying roller 252 driven to rotate by a sub-scan motor (not shown) at proper timing.

As a paper output section for outputting the sheet 242 on which an image has been recorded by the liquid ejection heads 234, the image forming apparatus 1000 further includes a separation claw 261 for separating the sheet 242 from the conveying belt 251, a first output roller 262, and a second output roller 263. A paper output tray 203 is disposed under the first output roller 262.

A duplex (both-side printing) unit 271 is detachably mounted to a rear portion of the apparatus body. The duplex unit 271 serves to take in the sheet 242 which is returned with reversed rotation of the conveying belt 251, and to feed the sheet 242 again to a gap between the counter roller 246 and the conveying belt 251 after turning the sheet 242 upside down. Additionally, a manually feed tray 272 is disposed at the top of the duplex unit 271.

Further, in a non-printing region positioned at one side in the main scan direction in which the carriage 233 is moved, a maintaining/restoring mechanism 281 is disposed to serve as a maintaining/restoring device to maintain and restore the nozzles of the liquid ejection heads 234 in and to normal states.

The maintaining/restoring mechanism 281 includes, for example, cap members (hereinafter referred to simply as an "caps") 282*a* and 282*b* (also called "caps 282" when the individual caps are not required to be discriminated) for capping respective nozzle surfaces of the liquid ejection heads 234, a wiper blade 283 which serves as a blade member for wiping the nozzle surfaces, and a non-recording ejection receiver 284 for receiving liquid droplets when non-recording ejection is performed by ejecting the liquid droplets which do not contribute to the recording, for the purpose of discharging the recording liquid having increased viscosity.

In a non-printing region positioned at the other side in the main scan direction in which the carriage 233 is moved, an ink recovery unit (non-recording ejection receiver) 288 is disposed which serves as a liquid recovery container for receiving liquid droplets, when non-recording ejection is performed during, e.g., the recording by ejecting the liquid droplets which do not contribute to the recording, for the purpose of discharging the recording liquid having increased viscosity. The ink recovery unit 288 includes openings 289 extending in the direction of the nozzle rows of the liquid ejection heads 234, etc.

In the image forming apparatus 1000 thus constructed, each of the sheets 242 is separated and fed from the paper feed tray 202. The sheet 242 having been fed substantially vertically upward is guided by the guide member 245 and is conveyed while it is sandwiched between the conveying belt 251 and the counter roller 246. Further, the leading end of the sheet 42 is guided by the conveying guide member 247 and is pressed against the conveying belt 251 by the leading-end pressing roller 249 such that the conveying direction of the sheet 242 is turned through substantially 90°.

At that time, an alternating voltage providing alternately repeated plus output and minus output is applied to the charging roller 256 such that the conveying belt 251 has an alternately charged voltage pattern, i.e., such that the conveying belt 251 is alternately charged to be plus and minus in successive zones each having a predetermined width, which are divided in the circulating direction of the conveying belt 251, i.e., in the sub-scan direction. When the sheet 242 is fed onto the conveying belt 251 which is alternately charged to be plus and minus as described above, the sheet 242 is attracted to the conveying belt 251 and is conveyed in the sub-scan direction with the circulative movement of the conveying belt 251.

By driving the liquid ejection heads 234 in accordance with an image signal while moving the carriage 233, ink droplets are ejected toward the sheet 242, which is held standstill, thereby recording an image of one line. After conveying the sheet 242 through a predetermined distance, recording for a next line is started. Upon receiving an end-of-recording signal or a signal indicating that the tailing end of the sheet 242 has reached a recording region, the recording operation is brought an end and the sheet 242 is output to the paper output tray 203.

Thus, in such a serial image forming apparatus, with the liquid ejection head according to the above-described or other exemplary embodiments of the present invention, a stable droplet ejection characteristic can be obtained and a high-quality image can be recorded at high speed.

In the above-described embodiment, the liquid ejection head is applied to the image forming apparatus constructed as a printer. It should be noted that a liquid ejection head according to an exemplary embodiment of the present invention may be applied to another type of image forming apparatus, such as a facsimile machine, a copier, or a multifunctional device having functions of a printer, a facsimile machine, and a copier. Further, the present invention is applicable to a liquid ejection head or an image forming apparatus capable of using a liquid other than a recording liquid.

Numerous additional modifications and variations are possible in light of the above teachings. It is therefore to be understood that, within the scope of the appended claims, the disclosure of this application may be practiced otherwise than as specifically described herein.

Furthermore, elements and/or features of different exemplary embodiments and/or examples may be combined with each other and/or substituted for each other within the scope of this disclosure and appended claims.

The present patent application claims priority under 35 U.S.C. §119 from Japanese Patent Application No. 2007-050886 filed on Mar. 1, 2007 in the Japan Patent Office, the entire contents of which are hereby incorporated herein by reference.

What is claimed is:

1. A liquid ejection head comprising:

a plurality of nozzles configured to eject liquid droplets;

a plurality of pressurizing liquid chambers in fluid communication respectively with the nozzles;

a liquid supply portion comprising a plurality of individual supply channels in fluid communication respectively with the pressurizing liquid chambers to supply a liquid to the pressurizing liquid chambers, and a fluid-communicating portion configured to keep the plurality of individual supply channels in fluid communication with one another;

a filter portion positioned to face the individual supply channels of the liquid supply portion and configured to filter the liquid supplied to the pressurizing liquid chambers; and a flow channel member in which the pressurizing liquid chambers and the liquid supply portion are formed, the flow channel member comprising:

a plurality of through grooves penetrating through the flow channel member in a direction of thickness thereof and including the pressurizing liquid chambers and the individual supply channels; and a recess extending in a direction in which the pressurizing liquid chambers are arrayed, the recess configured to keep portions of the plurality of through grooves in fluid communication with one another, the portions serving as the individual supply channels, wherein the portions of the through grooves, which serve as the individual supply channels, are open to a bottom of the recess and are positioned to face the filter portion.

2. The liquid ejection head according to claim 1, wherein peripheral portions of the recess around the bottom thereof are each formed in a curved shape.

3. The liquid ejection head according to claim 1, wherein each of the through grooves has a round edge on a side opposite a side facing a nozzle plate in which the nozzles are formed.

4. The liquid ejection head according to claim 1, wherein the through grooves are formed by press working and the recess is formed by wet etching.

5. The liquid ejection head according to claim 1, wherein the flow channel member is a single plate member.

6. The liquid ejection head according to claim 1, further comprising a vibrating plate member that defines one side of the pressurizing liquid chamber, wherein the filter portion is formed in the vibrating plate member.

7. A liquid cartridge, comprising, a liquid ejection head configured to eject liquid droplets; and a liquid container configured to supply liquid to the liquid ejection head, the liquid ejection head comprising:

a plurality of nozzles configured to eject liquid droplets;

a plurality of pressurizing liquid chambers in fluid communication respectively with the nozzles;

a liquid supply portion comprising a plurality of individual supply channels in fluid communication respectively with the pressurizing liquid chambers to supply a liquid to the pressurizing liquid chambers, and a fluid-communicating portion configured to keep the plurality of individual supply channels in fluid communication with one another;

a filter portion positioned to face the individual supply channels of the liquid supply portion and configured to filter the liquid supplied to the pressurizing liquid chambers; and a flow channel member in which the pressurizing liquid chambers and the liquid supply portion are formed, the flow channel member comprising:

a plurality of through grooves penetrating through the flow channel member in a direction of thickness thereof and including the pressurizing liquid chambers and the individual supply channels; and a recess extending in a direction in which the pressurizing liquid chambers are arrayed, the recess configured to keep portions of the plurality of through grooves in fluid communication with one another, the portions serving as the individual supply channels, wherein the portions of the through grooves, which serve as the individual supply channels, are open to a bottom of the recess and are positioned to face the filter portion.

8. An image forming apparatus comprising a liquid ejection head, the liquid ejection head comprising:

a plurality of nozzles configured to eject liquid droplets;

a plurality of pressurizing liquid chambers in fluid communication respectively with the nozzles;

a liquid supply portion comprising a plurality of individual supply channels in fluid communication respectively with the pressurizing liquid chambers to supply a liquid to the pressurizing liquid chambers, and a fluid-communicating portion configured to keep the plurality of individual supply channels in fluid communication with one another;

a filter portion positioned to face the individual supply channels of the liquid supply portion and configured to filter the liquid supplied to the pressurizing liquid chambers; and a flow channel member in which the pressurizing liquid chambers and the liquid supply portion are formed, the flow channel member comprising:

a plurality of through grooves penetrating through the flow channel member in a direction of thickness thereof and including the pressurizing liquid chambers and the individual supply channels; and a recess extending in a direction in which the pressurizing liquid chambers are arrayed, the recess configured to keep portions of the plurality of through grooves in fluid communication with one another, the portions serving as the individual supply channels, wherein the portions of the through grooves, which serve as the individual supply channels, are open to a bottom of the recess and are positioned to face the filter portion.

9. The image forming apparatus according to claim 8, wherein peripheral portions of the recess around the bottom thereof are each formed in a curved shape.

10. The image forming apparatus according to claim 8, wherein each of the through grooves has a round edge on a side opposite a side facing a nozzle plate in which the nozzles are formed.

11. The image forming apparatus according to claim 8, wherein the through grooves are formed by press working and the recess is formed by wet etching.

12. The image forming apparatus according to claim 8, wherein the flow channel member is a single plate member.

13. The image forming apparatus according to claim 8, wherein the liquid ejection head further comprises a vibrating plate member that defines one side of the pressurizing liquid chamber, and the filter portion is formed in the vibrating plate member.

14. The liquid cartridge according to claim 7, wherein peripheral portions of the recess around the bottom thereof are each formed in a curved shape.

15. The liquid cartridge according to claim 7, wherein each of the through grooves has a round edge on a side opposite a side facing a nozzle plate in which the nozzles are formed.

16. The liquid cartridge according to claim 7, wherein the through grooves are formed by press working and the recess is formed by wet etching.

17. The liquid cartridge according to claim 7, wherein the flow channel member is a single plate member.

18. The liquid cartridge according to claim 7, wherein the liquid ejection head further comprises a vibrating plate member that defines one side of the pressurizing liquid chamber, and the filter portion is formed in the vibrating plate member.

* * * * *